US005526608A

United States Patent [19]

Stark

[11] Patent Number: 5,526,608

[45] Date of Patent: Jun. 18, 1996

[54] EXTRUDED WINDOW JAMB LINER WITH YIELDABLE SEALING MEANS

[75] Inventor: Ivan L. Stark, Ada, Mich.

[73] Assignee: Newell Manufacturing Company, Lowell, Mich.

[21] Appl. No.: 352,536

[22] Filed: Dec. 9, 1994

[51] Int. Cl.[6] ..... E05D 13/00

[52] U.S. Cl. ..... 49/419; 49/414; 16/197

[58] Field of Search ..... 49/414, 419, 428, 49/429, 430; 16/197, 199

[56] References Cited

U.S. PATENT DOCUMENTS

| | | | |
|---|---|---|---|
| 3,078,523 | 2/1963 | Martin . | |
| 3,145,433 | 8/1964 | Jones . | |
| 3,184,016 | 5/1965 | Smith et al. . | |
| 3,203,053 | 8/1965 | Lane et al. . | |
| 3,399,490 | 9/1968 | Hettinger | 49/414 |
| 3,441,978 | 5/1969 | Perry . | |
| 3,442,059 | 5/1969 | Kessler . | |
| 3,553,916 | 1/1971 | Lickliter et al. . | |
| 3,744,199 | 7/1973 | Navarre . | |
| 3,924,373 | 12/1975 | Lizdas et al. . | |
| 3,998,027 | 12/1976 | Wendt et al. . | |
| 4,005,558 | 2/1977 | Barrison . | |
| 4,034,514 | 7/1977 | Cecil . | |
| 4,266,387 | 5/1981 | Karlsson . | |
| 4,470,222 | 9/1984 | Killingsworth . | |
| 4,726,148 | 2/1988 | Tix . | |
| 5,199,219 | 4/1993 | Martini et al. | 49/414 X |
| 5,265,308 | 11/1993 | May et al. | 49/419 X |
| 5,375,376 | 12/1994 | Scott | 49/419 X |

FOREIGN PATENT DOCUMENTS 1006620 6/1963 United Kingdom .

OTHER PUBLICATIONS

Exhibit A is a product brochure entitled "Jambliner/Balance Assemblies" published by Intek Weatherseal Products, Inc., Hastings, Minnesota, publication date unknown, which discloses a jamb liner including a pair of flexible hinge legs each supported by a tubular hinge arrangement.

Exhibit B is a product brochure entitled "Jambliner/Balance Assemblies" published by Intek Weatherseal Products Inc., Hastings, Minnesota, publication date unknown, which discloses a jamb liner including a pair of flexible hinge legs each supported by a tubular hinge arrangement.

*Primary Examiner*—Jerry Redman

*Attorney, Agent, or Firm*—Price, Heneveld, Cooper, DeWitt & Litton

[57] ABSTRACT

A jamb liner is provided for a window assembly including a frame and a sash operably mounted in the frame by use of the jamb liner. The jamb liner includes a sash-engaging portion having at least one pair of opposing wall sections and a bottom wall section defining a channel. An air-sealing portion extends from the opposing wall sections for sealingly engaging the frame to prevent undesired flow of air between the jamb liner and the window frame. The air-sealing portion includes a root wall section that extends at an angle to one of the opposing wall sections, a resilient wall section that extends from the root wall section, and a frame-engaging wall section that extends from the resilient wall section. In one form, a pair of the resilient wall sections are provided for supporting the frame-engaging wall section, one extending from each opposing wall section in a bellows-like arrangement. Each of the resilient wall sections may include multiple strips of resilient material interconnected by strips of structural material where additional flexural strength is desired.

29 Claims, 2 Drawing Sheets

EXTRUDED WINDOW JAMB LINER WITH YIELDABLE SEALING MEANS

BACKGROUND OF THE INVENTION

The present invention concerns a jamb liner for a window assembly, and more particularly concerns a jamb liner configured to provide an air seal against a window frame despite dimensional variations between the window frame and the jamb liner.

Many window frame assemblies include a frame, a jamb liner and a resilient foam block positioned between the jamb liner and the window frame to fill gaps between the jamb liner and the window frame and to thus reduce the flow of air through the window assembly. However, the foam often loses its resiliency over time and takes a permanent set, thus leading to undesirable air leaks. Also, foam can allow the jamb liner to bow, which results in inconsistent and possibly inadequate or excess operational forces on a slideable sash operably positioned in the window assembly. Still further, foam can make the jamb liner more difficult to install.

U.S. Pat. No. 5,265,308 discloses four different jamb liners in FIGS. 1–2, FIGS. 3–4, FIGS. 5–6 and FIG. 7, each having a relatively stiff strip-like member connected to the rear of the jamb liner by a co-extruded spring hinge member comprising resilient material. In the embodiments of FIGS. 1–2, FIGS. 5–6 and FIG. 7, the resilient material is located directly adjacent (extends contiguously along) the rear of a wall defining a sash-engaging guideway in the jamb liner, and in the embodiment of FIGS. 3–4, the resilient material extends contiguously along the rear of a wall defining a close-out/attachment panel at the lateral edge of the jamb liner. In each case, the resilient material extends directly along and immediately adjacent an outer surface of a wall of the jamb liner; however, this can cause several undesirable results which adversely affect the appearance and/or functionality of the wall as well as the operation of the hinge sought to be implemented. Further, this type of arrangement includes a structurally complex elongated hollow tube and or cylinder to which one edge of a finlike strip is attached, such that the tube or cylinder actually provides the bending hinge action. This is believed unduly complex and difficult to co-extrude in a continuous unwarped profile due to differential cooling rates of the resilient material of the hinge and the stiff material of the jamb liner. Another difficulty with such jamb liners is that the resilient hinge members are positioned at an outermost edge of the jamb liner, next to the frame, where they can be contacted by and compressed between the jamb liner and the window frame, which is undesirable.

Thus, an improved jamb liner is desired that provides a resilient hinge member spaced from the sash-engaging or main portion of a jamb liner, which may be utilized to provide a more continuous and gradual resilient biasing effect and/or to provide a positive limiting action to the hinging effect, and which can be readily and consistently manufactured.

SUMMARY OF THE INVENTION

The present invention includes a jamb liner for a window assembly having a frame and a sash operably mounted in the frame. The jamb liner includes a sash-engaging portion defining a channel for guiding movement of the sash in the frame. The jamb liner further includes an air-sealing portion connected to the sash-engaging portion including a root wall section extending from the sash-engaging portion, a resilient wall section extending from the root wall section, and a frame-engaging wall section extending from the resilient wall section. The resilient wall section preferably has about the same thickness as the root wall section and the frame-engaging wall section to facilitate the extruding process. The resilient wall section is co-extensive with the frame-engaging wall section and positions the frame-engaging wall section in a position spaced from the bottom of the sash-engaging wall section. The resilient wall section biases the frame-engaging wall section away from the bottom of the sash-engaging portion such that the frame-engaging wall section seals against the frame substantially the entire length of the jamb liner to prevent undesired flow of air between the jamb liner and the frame. The root wall section also reinforces a wall on the sash-engaging portion to prevent longitudinal distortion thereof, such as during cooling, and still further spaces the resilient wall section away from the sash-engaging portion to facilitate co-extrusion of the jamb liner and to prevent the resilient wall section from undesirably affecting the aesthetics and/or functionality/shape of the sash-engaging portion. In certain embodiments the overall configuration and positioning of the wall sections provides an automatic positive limiting effect for the resilient hinging, and in other embodiments a desirable extended, broad-based hinge structure is provided by which a gradual, consistent biasing effect is obtained.

These and other features and advantages of the present invention will be recognized by those who practice the invention and by those skilled in the art, based on a thorough reading in view of the specification, claims and appended figures.

DETAILED DESCRIPTION OF PREFERRED EMBODIMENTS

Figure 1:
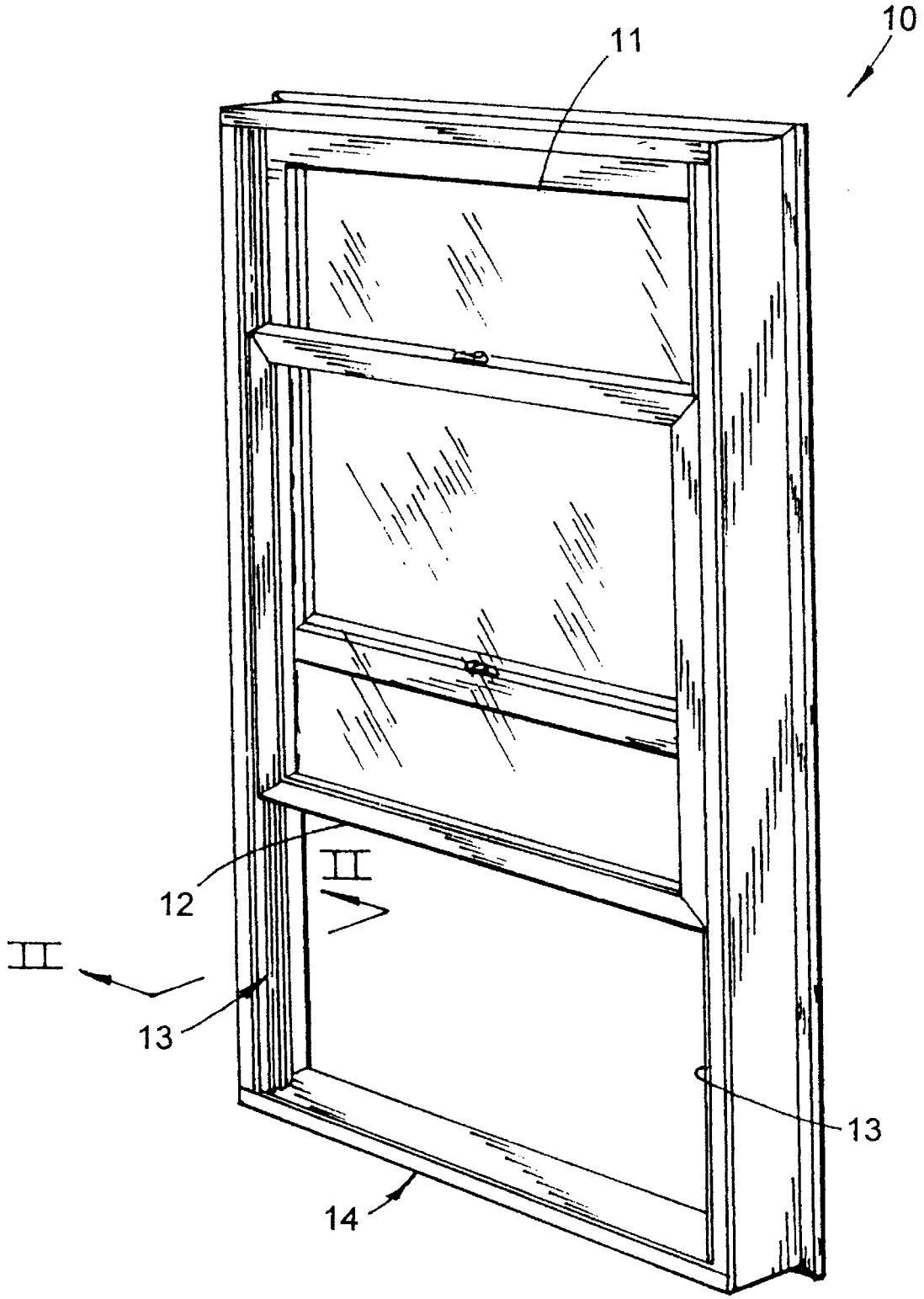
FIG. 1 is a perspective view of a window assembly including an extruded window jamb liner embodying the present invention.

Referring to FIG. 1, a window assembly 10 is shown including extruded jamb liners embodying the present invention. Window assembly 10 is of the double-hung type, having an upper sash 11 and a lower sash 12. The lower sash 12 is supported for sliding vertical movement between a pair of jamb liners 13, one on each side of the window frame 14. Only one jamb liner 13 is visible in FIG. 1; however, the jamb liners 13 are mirror images of each other and operate in identical ways. Thus, to facilitate a concise discussion, only one jamb liner is discussed hereinafter.

Figure 2:
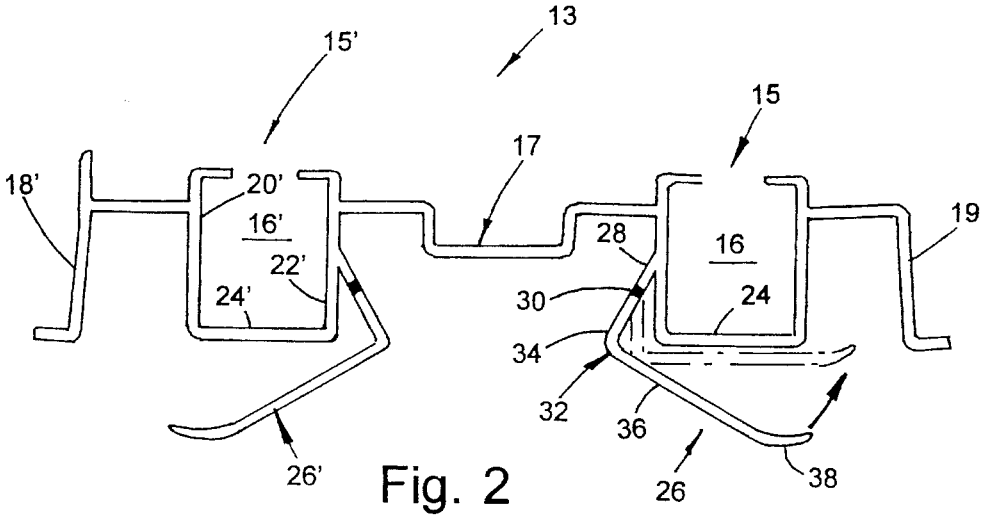
FIG. 2 is a cross-sectional view taken along the lines II—II in FIG. 1.

The illustrated jamb liner 13 is made primarily of polymeric material such as PVC and is configured for guiding the vertical movement of the sashes 11 and 12. For this purpose, the sash-engaging portion of jamb liner 13 defines a pair of elongated channels 15 and 15' (FIG. 2), one for each sash, which are interconnected by a mullion 17 and include a pair of mounting and retaining panels 18 and 19 on each side.

Channels 15 and 15' are substantially identical, and to simplify the present discussion, comparable or identical components of channel 15' to channel 15 are identified with the identical number but with the addition of a prime adjacent the number.

Channel 15 is configured to guide lower sash 12 and is representative of channels typically used for guiding a window sash. Channel 15 is U-shaped and includes an inner space 16 configured to receive a friction-generating sash support (not specifically shown). The friction-generating support is adapted to slide within elongated channel 15 and support the weight of sash 12 when sash 12 is released. Friction-generating supports for a window sash are generally known in the art and need not be discussed in detail in this application for a complete understanding of the present invention.

Figure 3:
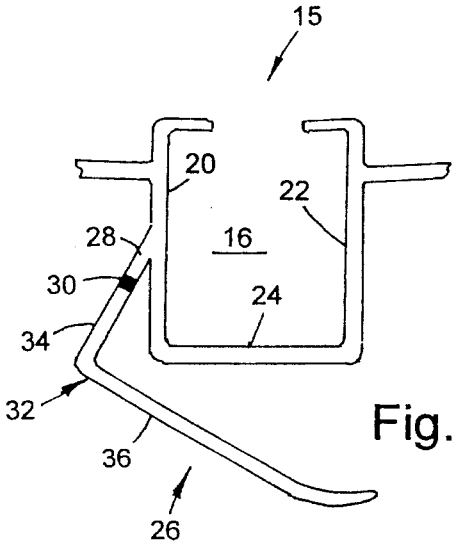
FIG. 3 is an enlarged fragmentary view of the jamb liner shown in FIG. 2.

The present invention is focused in jamb liner 13. Jamb liner 13 includes a U-shaped sash-engaging portion having opposing wall sections 20 and 22 and a bottom wall section 24 (FIG. 3) defining the U-shaped channel 15. An air-sealing and resilient biasing portion 26 extends from one of the opposing wall sections 20 and 22 for sealingly engaging the frame 14 to prevent undesirable flow or leakage of air between the jamb liner 13 and window frame 14. The air-sealing portion 26 includes a root wall section 28 that extends downwardly at about a 45° angle with respect to one of the opposing wall sections 20 and 22, generally from the center thereof. The 45° angle optimizes stress distribution in air-sealing portion 26 relative to opposing wall section 20. Air-sealing portion 26 further includes a resilient wall section 30 that extends from the root wall section 28, and a frame-engaging wall section 32 that extends from the resilient wall section 30.

Frame-engaging wall section 32 is L-shaped, and includes a first leg 34 that aligns co-extensively with root wall section 28 and resilient wall section 30, and a frame-engaging second leg 36 that extends generally perpendicularly to first leg 34. An outer edge 38 of second leg 36 is arcuately shaped to provide a relatively wide contact area for sealing against frame 14. The wide contact area provides good closure against frame 14 regardless of the relative angle of second leg 36 to frame 14. In particular, the arcuate shape defines a longer, more tortuous path for air leaked between edge 38 and frame 14 even if frame 14 includes a local defect causing a minor local gap between outer edge 38 and frame 14.

The wall thicknesses of air-sealing portion 26 (i.e. wall sections 28, 30 and 32 including legs 34 and 36) are generally equal to main jamb liner wall sections 20, 22 and 24 to facilitate co-extrusion of jamb liners 13. In particular, jamb liner 13 is co-extruded of a flexible resilient material making up resilient wall section 30, and a structural, generally rigid PVC material making up the remaining wall sections 17, 18, 19, 20, 22, 24, 28 and 32. The preferred flexible material is a thermoplastic elastomer having a Shore Hardness of A80–A95, such as Estane™ material marketed by B. F. Goodrich Corporation. The resiliency of the flexible resilient material causes it to bias the frame-engaging wall section 32 against the frame 14 substantially fully along the length of frame 14 despite dimensional variations in jamb liner 13 and frame 14. Also, the resilient material has a long life and does not tend to take a set over time.

In use, jamb liner 13 is attached to frame 14 with leg 36 located between bottom wall section 24 and window frame 14. Resilient wall section 30 biases leg 36 against window frame 14 to take up any gap between bottom wall section 24 and window frame 14, and thus prevent leakage of air therebetween. In those instances where window frame 14 locally juts toward bottom wall section 24, leg 36 may be forced flat against bottom wall section 24 across all or part of its width. Thus, leg 36 may engage all of bottom wall section 24 from side-to-side, but does not cause bottom wall section 24 to unnecessarily twist or distort. Thus, channel 15 is not significantly distorted by such circumstances and does not cause interference with the free movement of the sash support member which travels along channel 15. In fact, leg 36 supports and helps maintain bottom wall section 24 (and channel 15) in a square position relative to window frame 14 and sash 13. Alternatively, leg 36 may be configured to contact bottom wall section 24 at an angle, whereby the extent of allowable motion toward the latter, and the corresponding hinging action is positively limited, without significant distortion of channel 15.

ALTERNATIVE EMBODIMENT

Figure 4:
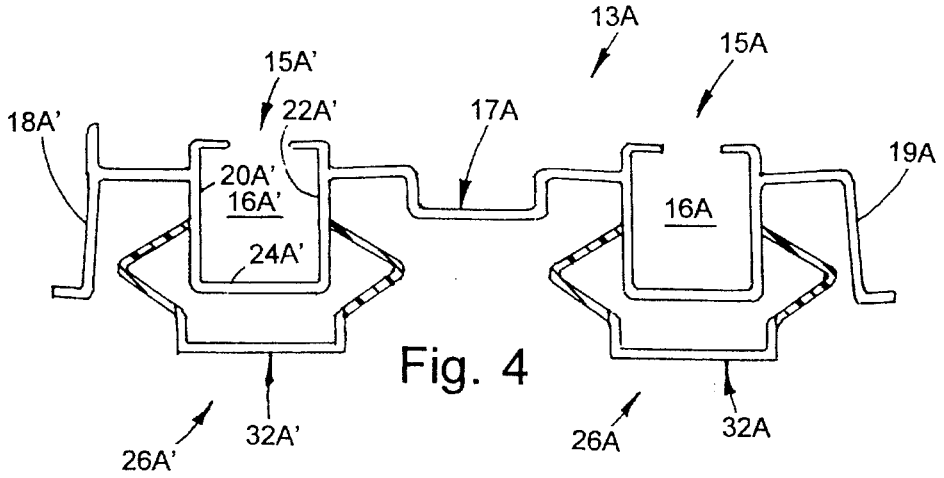
FIG. 4 is a fragmentary cross-sectional view of a modified jamb liner embodying the present invention.
Figure 5:
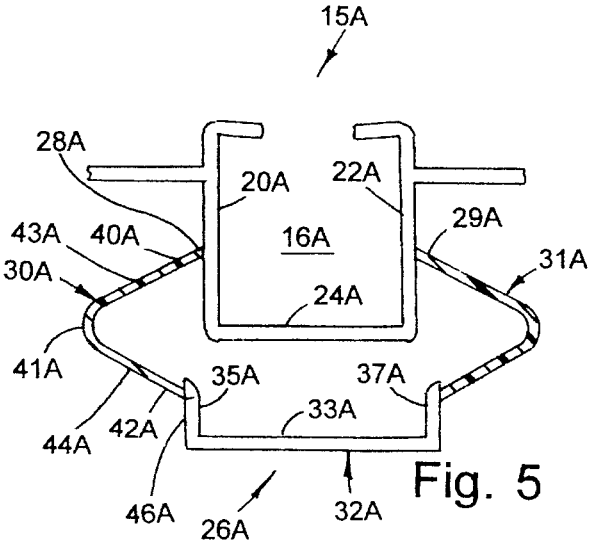
FIG. 5 is an enlarged fragmentary view of the jamb liner shown in FIG. 4.

An alternative form of jamb liner 13A embodying the present invention is shown in FIGS. 4–5. For purposes of description, the features of jamb liner 13A which are identical or comparable to jamb liner 13 are identified with identical numbers, but with the addition of the letter "A".

In jamb liner 13A, frame-engaging wall section 32A is U-shaped, and includes a planar bottom wall section 33A that extends generally parallel bottom wall section 24A, and side legs 35A and 37A that extend generally perpendicular to bottom wall section 33A. Air-sealing portion 26A includes a pair of root wall sections 28A and 29A that extend from opposing channel wall sections 20A and 22A, and further includes a pair of resilient wall sections 30A and 31A that interconnect frame-engaging wall sections 32A with root wall sections 28A and 29A, respectively. Resilient wall sections 30A and 31A are mirror images of each other, and therefore only resilient wall section 30A will be described hereinafter.

Resilient wall section 30A includes three strips 40A, 41A and 42A of resilient material interconnected by strips 43A and 44A of structural (PVC) material. Strip 40A is integrally attached to root wall section 28A and strip 42A is integrally connected proximate the edge 46A of frame-engaging wall section 32A on side leg 35A. The arrangement of resilient wall section 30A and 31A with frame-engaging wall section 32A and bottom wall section 24A creates a bellows-like structure wherein resilient wall sections 30A and 31A flex outwardly as frame-engaging wall section 32A is deflected toward bottom channel wall section 24A. The resiliency of resilient wall sections 30A and 31A biases frame-engaging wall section 32A outwardly into sealing engagement with frame 14A, even if frame 14A dimensionally varies longitudinally. Also, the lateral width of the bottom wall 33A on frame-engaging wall section 32A creates a tortuous path between the bottom wall section 33A and frame 14A even if frame 14A is locally deformed or otherwise includes a non-planar surface.

The mutually spaced, multiple resilient wall sections of the jamb liner 13A provide a broad-based, wide and extensive resilient hanging characteristic which facillitates smooth and continuous biasing effects as well as providing a way to better and more consistently control the biasing effect, since the resilient hinging occurs at a number of places at once and over an extensive total bending area.

Thus, jamb liners are provided that include an air-sealing member that is resiliently supported on the channel. The jamb liner is co-extruded of a resilient material and structural material in an arrangement preferably having a constant wall thickness to facilitate manufacture. Further, the portion of the jamb liner that sealingly engages the window frame is configured to uniformly support the bottom wall section of the jamb liner to help compensate for irregularities in the window frame.

It will be readily appreciated by those skilled in the art that modifications may be made to the invention without departing from the concepts disclosed herein. All such modifications are to be considered as included in the following claims, unless these claims by their language expressly state otherwise.

The embodiments of the invention in which an exclusive property or privilege is claimed are defined as follows:

1. A jamb liner for a window assembly including a frame and a sash operably mounted in the frame, comprising:

a sash-engaging portion defining a channel having opposing wall sections for guiding movement of the sash in the frame; and an air-sealing portion for positioning the jamb liner relative to said frame and for preventing flow of air therebetween, said air-sealing portion being connected to said sash-engaging portion and including a root wall section extending from one of said opposing wall sections said sash-engaging portion, a resilient wall section comprising of a more resilient material than said opposing wall sections and operably connected to frame-engaging wall section connected to said resilient wall section, and further comprising a material of similar stiffness as said opposing wall sections, said resilient wall section being co-extensive with said root wall section and said frame-engaging wall section, and positioning said frame-engaging wall section in a location spaced from said bottom wall section, said resilient wall section further biasing said frame-engaging wall section away from said bottom wall section such that said frame-engaging wall section is adapted to seal against the frame substantially the entire length of said jamb liner to prevent undesirable flow of air between said jamb liner and the frame.

2. A jamb liner as defined in claim 1 wherein said root wall section and said resilient wall section have equal thicknesses.

3. A jamb liner as defined in claim 2 wherein said root wall section extends at an angle from one of said opposing wall sections.

4. A jamb liner as defined in claim 3 wherein said angle is about 45°.

5. A jamb liner as defined in claim 1 wherein said sash-engaging portion, said root wall section and said frame-engaging wall section are made from structural material, said jamb liner being co-extruded from said structural material and said resilient material.

6. A jamb liner as defined in claim 1 wherein said sash-engaging portion includes a bottom wall section that defines a plane, and said frame-engaging wall section is positioned generally parallel to the plane.

7. A jamb liner as defined in claim 1 wherein said sash-engaging portion includes a bottom wall section interconnecting said opposing wall sections, and wherein said frame-engaging wall section is L-shaped, and includes a first leg positioned proximate one of said opposing wall sections and a second leg positioned proximate said bottom wall section, said second leg being configured to lay substantially flat against said bottom wall section when pressed thereagainst.

8. A jamb liner as defined in claim 1 wherein said resilient wall section includes a thermoplastic elastomer having a Shore Hardness of about A80–A96.

9. A jamb liner as defined in claim 1, and second resilient wall section, said resilient wall sections operably connecting opposite ends of said frame-engaging wall section to said opposing wall sections.

10. A jamb liner as defined in claim 9 wherein said frame-engaging wall section is U-shaped.

11. A jamb liner as defined in claim 10 wherein said resilient wall sections both include alternating strips of resilient material and structural material.

12. A jamb liner as defined in claim 1 wherein said resilient wall section includes at least two strips of resilient elastomeric material interconnected by an intermediate strip of relatively stiff structural material.

13. A jamb liner for a window assembly including a frame and a sash operably mounted in the frame, comprising:

a sash-engaging portion including opposing wall sections and a bottom wall section defining a channel for guiding movement of the sash in the frame; and a bellow-shaped air-sealing portion including first and second root wall sections extending from said opposing wall sections and further including a frame-engaging wall section and first and second resilient wall sections connected to said first and second root wall sections for supporting said frame-engaging wall section, said resilient wall sections comprising a more resilient material than the opposing wall sections and said frame-engaging wall section, said resilient wall sections spacing said frame-engaging wall section away from said bottom wall section and further biasing said frame-engaging wall section away from said bottom wall section such that said frame-engaging wall section seals against the frame substantially the entire length of said jamb liner to prevent undesirable air flow between said jamb liner and the frame.

14. A jamb liner as defined in claim 13 wherein said resilient wall sections have about the same thickness as said frame-engaging wall section and are co-extensive therewith.

15. A jamb liner as defined in claim 13 wherein said jamb liner member is a co-extrusion of a flexible elastomeric material and a stiff material forming said resilient wall sections and a structural material forming all other wall sections of said jamb liner.

16. A jamb liner as defined in claim 13 wherein said resilient wall section includes a thermoplastic elastomer having a Shore Hardness of about A80–A96.

17. A jamb liner as defined in claim 13 wherein said frame-engaging wall section is U-shaped.

18. A jamb liner as defined in claim 17 wherein said first and second resilient wall sections are connected to edges of said U-shaped frame-engaging wall section.

19. A jamb liner as defined in claim 18 wherein said first and second resilient wall sections include alternating strips of resilient elastomeric material and structural material.

20. A jamb liner as defined in claim 13 wherein said first and second resilient wall sections each include at least two strips of resilient elastomeric material interconnected by a strip of structural material.

21. A jamb liner for a window assembly including a frame and a sash operably mounted in the frame, comprising:

a sash-engaging portion including opposing wall sections and a bottom wall section defining a channel for guiding movement of the sash in the frame;

an air-sealing portion connected to at least one of said opposing wall sections, said air-sealing member including a root wall section extending from one of said opposing wall sections which is made from the same material as said opposing wall sections, a resilient wall section connected to said root wall section, and comprising of a more resilient material than said opposing wall sections and a frame-engaging wall section connected to said resilient wall section and spaced from said bottom wall section; and further comprising a material of similar stiffness as said opposing wall sections and said root wall section, said resilient wall section, and a portion of said frame-engaging wall section forming a continuous planar panel that facilitates co-extruding the planar panel.

22. A jamb liner as defined in claim 21 wherein said root wall section extends at an angle from one of said opposing wall sections.

23. A jamb liner as defined in claim 21 wherein said one opposing wall section defines a plane, and said root wall section extends at a 45° angle to said plane.

24. A jamb liner as defined in claim 21 including a second root wall section connected to the other of said opposing wall sections, and a second resilient wall section connected to said second root wall section and to said frame-engaging wall section.

25. A jamb liner as defined in claim 24 wherein each of said first and second resilient wall sections includes at least two strips of resilient material interconnected by a strip of structural material.

26. A jamb liner as defined in claim 23 wherein said resilient wall section has a thickness approximately equal to the thickness of said opposing wall sections.

27. A jamb liner for a window assembly including a frame and first and second sashes operably mounted in the frame, comprising:

a sash-engaging portion including first and second spaced apart channel-defining members, said channel-defining members each having a bottom wall and opposing side walls extending from the bottom wall for guiding movement of the first and second sashes, respectively;

a first bellow-shaped air-sealing member having a first generally planar panel and first opposing resilient side walls extending from the opposing side walls of said first channel-defining member for spacing the first planar panel from the bottom wall of said first channel-defining member, said first opposing resilient side walls each including a strip of elastomeric material spaced from said first opposing side walls; and a second bellow-shaped air-sealing member having a second generally planar panel and second opposing resilient side walls extending from the opposing side walls of said second channel-defining member for spacing the second planar panel from the bottom wall of said second channel-defining member, said second opposing resilient side walls each including a strip of elastomeric material spaced from said second opposing side walls, said first and second air-sealing members being spaced apart and acting separately, whereby each of said first and second air-sealing members seal a space behind the bottom walls of said first and second channel-defining members, respectively.

28. A jamb liner as defined in claim 27 wherein said first and second opposing resilient side walls are connected to and extend at an acute angle from the opposing side walls of said first and second channel-defining members, respectively.

29. A jamb liner as defined in claim 27 wherein each of said opposing resilient side walls include at least a two strips of elastomeric material joined together by a strip of structural polymeric material.

* * * * *